US007827928B2

(12) United States Patent
Shaw et al.

(10) Patent No.: US 7,827,928 B2
(45) Date of Patent: Nov. 9, 2010

(54) TACTILE WARNING PAD WITH SHEARABLE ANCHOR MEMBERS

(75) Inventors: Mark D. Shaw, Ponte Vedra Beach, FL (US); J. Tad Heyman, Atlantic Beach, FL (US); Samuel Bates, Ponte Vedra, FL (US)

(73) Assignee: Ultra Tech International, Jacksonville, FL (US)

( * ) Notice: Subject to any disclaimer, the term of this patent is extended or adjusted under 35 U.S.C. 154(b) by 179 days.

(21) Appl. No.: 12/316,512

(22) Filed: Dec. 12, 2008

(65) Prior Publication Data

US 2009/0178608 A1 Jul. 16, 2009

Related U.S. Application Data

(60) Provisional application No. 61/007,284, filed on Dec. 12, 2007.

(51) Int. Cl.
*E04F 15/00* (2006.01)
*E04F 15/10* (2006.01)

(52) U.S. Cl. ..... 116/205; 404/19; 52/391

(58) Field of Classification Search ..... 116/205, 116/DIG. 17; 52/177, 181, 384, 385, 386, 52/388, 389, 391; 404/19, 20, 21, 32, 34, 404/35, 42, 43, 44, 45

See application file for complete search history.

(56) References Cited

U.S. PATENT DOCUMENTS

| | | | | | |
|---|---|---|---|---|---|
| 1,465,539 | A | * | 8/1923 | Atterbury | 52/366 |
| 2,721,369 | A | * | 10/1955 | Burke | 264/256 |
| 3,332,187 | A | * | 7/1967 | Arcari | 52/309.12 |
| 3,340,660 | A | * | 9/1967 | Arcari | 52/388 |
| 5,217,319 | A | | 6/1993 | Klohn | |
| 5,303,669 | A | | 4/1994 | Szekely | |
| 5,775,835 | A | * | 7/1998 | Szekely | 404/34 |
| 5,823,709 | A | * | 10/1998 | Maher et al. | 405/20 |

* cited by examiner

*Primary Examiner*—R. A. Smith
(74) *Attorney, Agent, or Firm*—Thomas C. Saitta

(57) ABSTRACT

A tactile warning pad composed of a polymer material, the pad comprising contact structures on its upper surface and embedded shearable anchor members in the form of a corrugated mesh webbing, wherein the upper portions of the mesh webbing are embedded within the pad and the lower portions of the mesh webbing extend below the pad, such that the pad may be positioned atop an uncured concrete base with the lower portions of the mesh webbing embedded within the concrete, and further such that the anchor members retain the pad on the concrete base once the concrete has hardened, and further such that the pad is removable from the concrete by shearing the anchor members at the interface between the concrete base and the polymer pad using a bladed shearing implement.

15 Claims, 3 Drawing Sheets

TACTILE WARNING PAD WITH SHEARABLE ANCHOR MEMBERS

This invention claims the benefit of U.S. Provisional patent Application Ser. No. 61/007,284, filed Dec. 12, 2007, the disclosure of which is incorporated by reference herein.

BACKGROUND OF THE INVENTION

This invention relates generally to the field of ground-based tactile warning surfaces, sometimes referred to as Braille pads, strips or surfaces, wherein a portion of a sidewalk, train platform or other surface that is traversed by pedestrians is provided with an embossed surface, often comprising a series of short truncated cones, bumps, ridges and/or other raised members, such that the change in physical surface texture provides warning information to a pedestrian, and in particular to a blind pedestrian, such as the abrupt end of a platform or the beginning of a street, through contact with a cane or other walking implement or by tactile sensation through the feet. The use of tactile warning surfaces has been mandated in many situations under the Americans with Disabilities Act.

The tactile warning surfaces are commonly either formed in one of two manners. The tactile warning surfaces may be formed directly out of wet concrete when the sidewalk or platform is laid, using properly configured molds, or the tactile warning surfaces may be pre-manufactured as pads or tiles composed of concrete or polymers that are later installed on site. The use of polymers as the material of construction for these pre-manufactured pads is beneficial in terms of lowering the cost of production, lowering shipping costs, providing options as to configuration and color, providing pads that readily conform to surface irregularities, and making handling and installation easier.

Because the polymer tactile warning pads are more susceptible to damage and degradation than the pre-manufactured concrete pads, the pads may ultimately require removal and replacement. One common method for securing the pads in place is to adhesively bond them to the concrete undersurface or base. While this method makes removal easier, the adhesive bonding layer is more susceptible to premature separation from the concrete base due to environmental factors such as temperature fluctuations, ultraviolet radiation, liquid intrusion or the like. Therefore, it is often preferable to provide the polymer pads with anchor members that can be inserted into the concrete base, either by pressing the anchor members into the wet concrete during the curing stage of wet concrete or by drilling holes into hardened concrete. While the use of anchor members provides better pad retention, the presence of the anchors makes removal and replacement of the pads more difficult. To address this problem, in some systems the anchor members comprise threaded bolts embedded in the concrete with exposed removable nuts, or internally threaded sleeves are embedded in the concrete and removable bolts are inserted into the sleeves. Examples of these systems are shown in U.S. Pat. No. 5,303,669 to Szekely and in U.S. Pat. No. 5,217,319 to Klohn. A significant problem with these systems is that the nut or the bolt head is either exposed above the pad or the pad must be provided with polymer covering members for the nuts or bolt heads. Still another problem is that a relatively large number of these discrete anchor members must be utilized to prevent the pad from buckling due to environmental degradation over time.

It is an object of this invention to provide a pre-manufactured polymer tactile warning pad with embedded anchor members, such that the anchor members can be pressed into wet concrete so as to retain the pad in position once the concrete hardens, wherein the anchor members comprise wavy apertured web or mesh members that are embedded within the polymer pad during manufacture, wherein the web or mesh anchor members provide laterally-extensive anchoring, and further wherein the anchor members are readily shearable such that removal of the pad is accomplished by inserting a shearing implement between the pad and the concrete to cut the anchor members. These objects, as well as other objects not expressly set forth in this paragraph, will be readily apparent upon review of the following disclosure.

SUMMARY OF THE INVENTION

The invention is a tactile warning surface pad composed of a polymer material, the pad having an embossed upper surface comprising for example raised truncated cones, bumps, ridges or the like, for tactile transmission of information to pedestrians, and in particular to blind pedestrians. Shearable anchor members in the form of a corrugated or wavy web or mesh sheet material shaped into undulating ridges and valleys and that is generally co-extensive with the pad, are embedded within the body of the pad such that the lower portions of the web or mesh material extend a distance below the pad to act as a bridging layer. To install the pad, the pad is placed onto an uncured concrete base and the anchor members are pressed into the wet concrete. Once the concrete has hardened, the pad is secured. To remove the pad for replacement, a bladed shearing implement is inserted between the pad lower surface and the cured concrete base upper surface and advanced along this intersection to shear the anchor members, thereby freeing the polymer pad for removal from the concrete base.

DETAILED DESCRIPTION OF THE INVENTION

Figure 1:
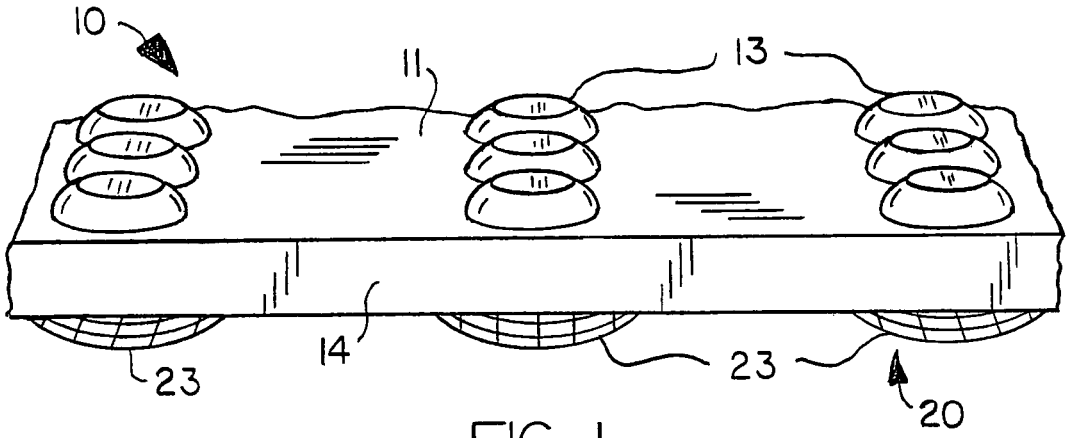
FIG. 1 is a perspective view showing the edge of a representative embodiment of the pad and anchor members.
Figure 3:
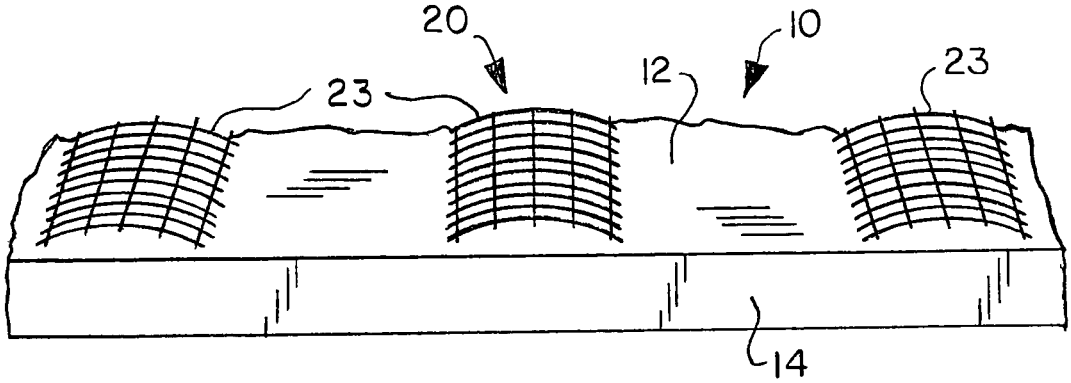
FIG. 3 is another perspective view of the embodiment of FIG. 1 showing the anchor members on the underside of the pad.
Figure 2:
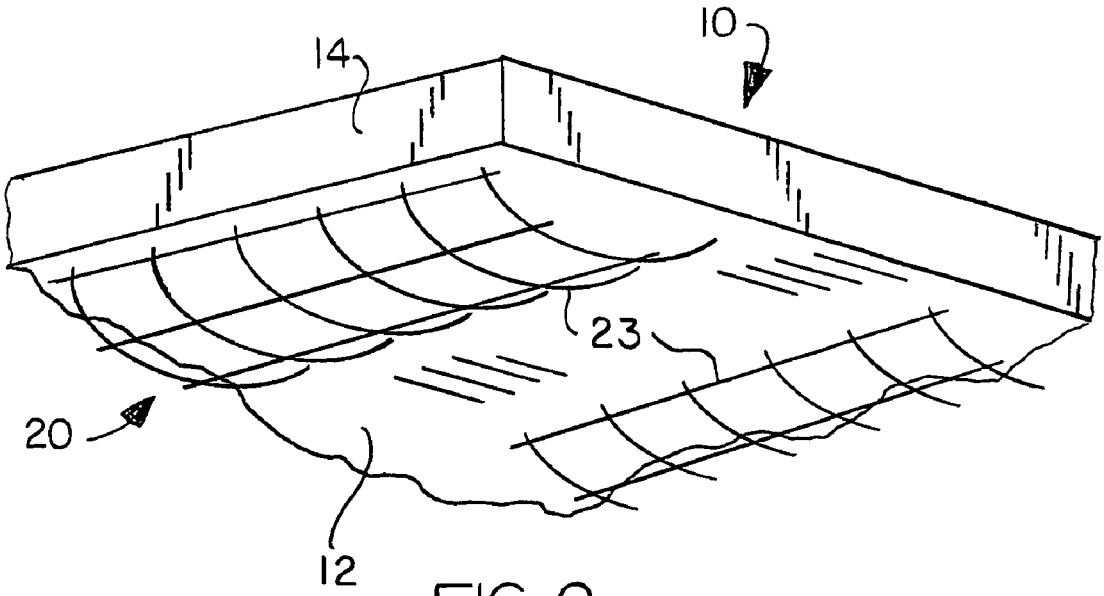
FIG. 2 is a perspective view of the embodiment of FIG. 1 showing the anchor members on the underside of the pad.

With reference to the figures, the invention will now be described in detail with regard for the best mode and the preferred embodiment. In a most general sense, the invention is a tactile warning pad meeting the requirements of the Americans with Disabilities Act, the pad offering tactile information to a sighted or blind pedestrian that a change in surface is about to occur, such as information alerting the pedestrian to the end of a raised platform, the edge of curb, the beginning of a street, etc. The pad is pre-manufactured and transported to the site for installation in wet, i.e., pre-cured, concrete or a similar bonding layer, the pad comprising a plurality of anchor members extending from its lower surface, the anchor members being easily implanted into the wet concrete without severely disrupting the surface of the concrete, and being of sufficient number and sufficiently co-extensively disposed relative to the pad that the pad is securely held onto the concrete after the concrete has cured and hardened.

The invention comprises a relatively thin, laterally co-extending, surface member, tile or pad 10 composed of a polymer material, such as for example a polyurethane elastomer, rubber, fiberglass reinforced polymer, polymer composites or the like, having a main body 14, an embossed upper surface 11 and a lower surface 12. Preferably the material of composition of the pad 10 provides for a degree of flexibility such that the pad 10 can somewhat conform to surface irregularities, such as hills or valleys encountered in a non-planar surface. A relatively large number of tactile contact structures 13 are provided on the upper surface 11, the contact structures 13 comprising for example truncated cones or bumps, ridges or other shapes, of sufficient size so as to be easily detected underfoot or with a cane by a blind pedestrian. Shearable anchor members 20 are embedded within the main body 14 of the polymer pad 10 to provide a bridging layer for securing the pad 10 to a concrete base 30.

Figure 4:
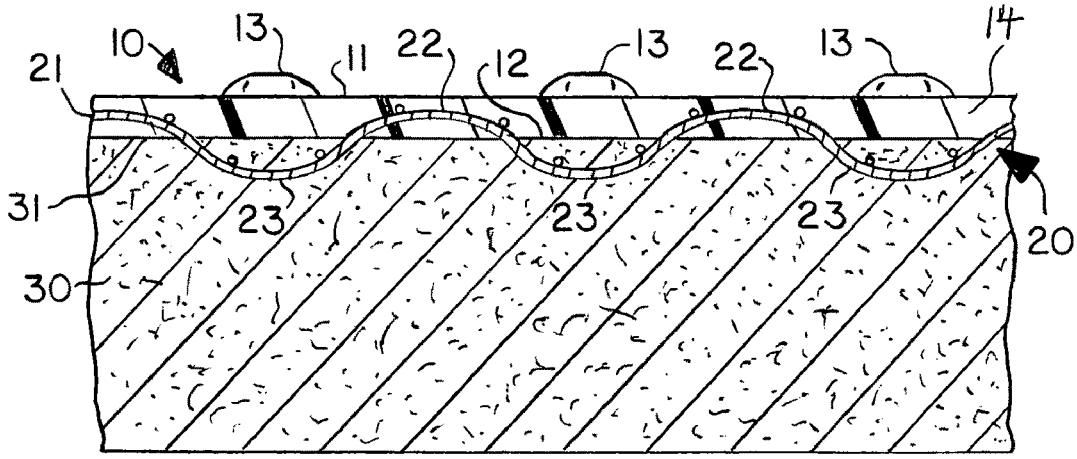
FIG. 4 is a cross-sectional view showing the pad affixed to a concrete base, with the lower portion of the anchor members embedded in the concrete.

The anchor members 20 are composed of a mesh or apertured web material composed of a material, such as for example a galvanized steel, aluminum or similar metal, that is relatively easily cut or sheared by lateral advancement of a bladed shearing implement 99. Because it is essential that the pad 10 be secured co-extensively to the concrete base 30 at a large number of locations to prevent buckling of the pad 10, the anchor members 20 preferably comprise a wire mesh or web 21 that has been given a corrugated, wavy or undulating configuration, such that the webbing 21 is shaped into a series of ridges and valleys prior to being embedded in the pad 10. With this configuration the upper ridge portions 22 of the wire mesh 21 are securely embedded within the pad 10 with excellent resistance to disengagement because any tensile forces are spread out within the pad body rather than being focused at individual points. The lower valley portions 23 of the wire mesh 21 extend downward from the pad lower surface 12 a sufficient distance so as to be securely embedded and retained by the concrete base 30, as seen in FIG. 4. The wire mesh 21 should have relatively large apertures and the wire itself should be relatively thin so as to readily embed into the wet concrete 30 without requiring excessive force, while at the same time not entrapping any air bubbles to weaken the bond between the pad 10 and the concrete 30. Preferably, the wire mesh 21 extends substantially co-extensively in the lateral dimensions with the main body 14 of the pad 10, as this provides the most secure anchoring, but it is also possible to utilize a plurality of discrete smaller sections of the wire mesh 21 embedded at multiple locations in the pad 10.

To install the pad 10, the concrete base 30 is poured and planed to present a relatively planar upper surface 31. Prior to the hardening of the concrete base 30, the pad 10 is properly positioned and the lower portion 23 of the anchor members 20 are pressed into the upper surface 31 of the wet concrete 30. The pad 10 is manipulated to insure that no air is entrapped and that the lower surface of the pad 10 coextensively contacts the upper surface of the wet concrete 30. When the concrete base 30 has cured, the concrete-embedded portions 23 of the anchor members 20 secure the pad 10 to the concrete base 30.

Figure 5:
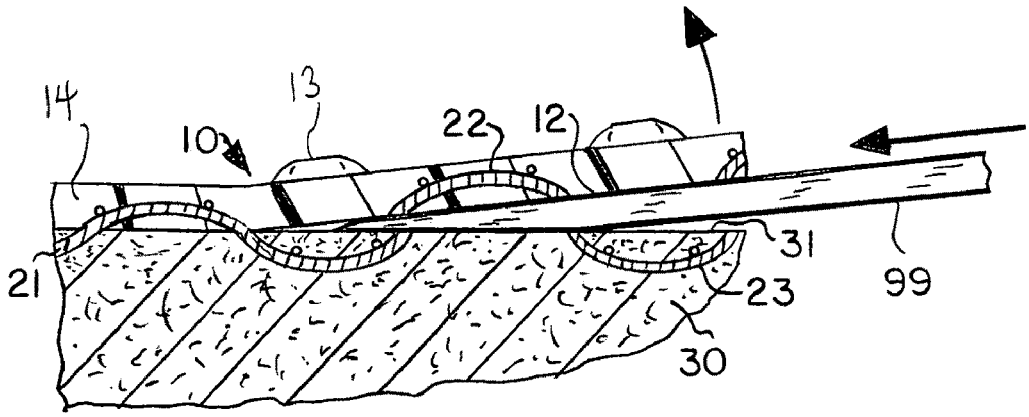
FIG. 5 is a cross-section view showing the pad being removed from the concrete base by insertion of a bladed shearing implement between the pad and concrete base to cut the anchor members.

To remove the pad 10, a shearing implement 99 having a generally planar shearing blade or edge is inserted into the interface between the pad 10 and concrete 20 and advanced, as shown in FIG. 5. The shearing implement 99 cuts the wire mesh 21 along the interface, allowing the pad 10 to be peeled up and removed. The shearing action does not damage the upper surface 31 of the concrete 30, and the anchor members 20 are sheared at this upper surface 31, enabling a replacement pad without anchor members to be adhesively bonded to the upper surface 31, or alternatively holes can be drilled into the concrete 30 for implantation of discrete anchor members. Furthermore, if conditions permit, a new layer of wet concrete can be applied and a tactile warning pad 10 as described herein can be anchored in place in the same manner as before.

It is contemplated that equivalents and substitutions for certain elements and structure set forth above may be obvious to those of ordinary skill in the art, and therefore the true scope and definition of the invention is to be as set forth in the following claims.

We claim:

1. A tactile warning pad composed of a polymer material, said pad comprising:

a main body, an upper surface and a lower surface;

raised contact structures positioned on said upper surface;

shearable anchor members embedded in said main body of said pad, said anchor members comprising a wire mesh material having a wavy configuration defining upper ridge portions and lower valley portions;

wherein said upper ridge portions are embedded within said main body of said pad and said lower valley portions extend from said lower surface of said pad.

2. The pad of claim 1, wherein said wire mesh material extends substantially co-extensively with said main body of said pad.

3. The pad of claim 1, wherein said contact structures are chosen from the group of contact structures consisting of truncated cones, bumps and ridges.

4. The pad of claim 1, wherein said pad is flexible.

5. The pad of claim 1, wherein said polymer material is chosen from the group of polymer materials consisting of polyurethane elastomers, rubbers, fiberglass reinforced polymers, and polymer composites.

6. A tactile warning pad composed of a polymer material;

said pad comprising a main body, an upper surface and a lower surface, and further comprising contact structures on said upper surface and embedded shearable anchor members in the form of a corrugated mesh webbing comprising upper ridge portions and lower valley portions, wherein said upper ridge portions of said mesh webbing are embedded within said main body of said pad and said lower valley portions of said mesh webbing extend below said lower surface of said pad;

said pad being adapted to be positioned atop an uncured concrete base with said lower portions of said mesh webbing embedded within said concrete base, and further such that said anchor members retain said pad on said concrete base once said concrete base has hardened, and further such that said pad is removable from said concrete base by shearing said anchor members at the interface of said concrete base and said polymer pad using a shearing implement.

7. The pad of claim 6, wherein said wire mesh material extends substantially co-extensively with said main body of said pad.

8. The pad of claim 6, wherein said contact structures are chosen from the group of contact structures consisting of truncated cones, bumps and ridges.

9. The pad of claim 6, wherein said pad is flexible.

10. The pad of claim 6, wherein said polymer material is chosen from the group of polymer materials consisting of polyurethane elastomers, rubbers, fiberglass reinforced polymers, and polymer composites.

11. A tactile warning pad and concrete base assembly;

said pad composed of a polymer material, the pad comprising a main body, an upper surface and a lower surface, and further comprising contact structures on said upper surface and embedded shearable anchor members in the form of an undulating mesh webbing comprising upper ridge portions and lower valley portions, wherein said upper ridge portions of said mesh webbing are embedded within said main body of said pad and said lower valley portions of said mesh webbing extend below said lower surface of said pad;

said pad positioned atop a concrete base with said lower portions of said mesh webbing embedded within said concrete base, said pad and said concrete base defining an interface;

wherein said pad is removable from said concrete base upon shearing said anchor members at said interface of said concrete base and said polymer pad.

12. The assembly of claim 11, wherein said wire mesh material extends substantially co-extensively with said main body of said pad.

13. The assembly of claim 11, wherein said contact structures are chosen from the group of contact structures consisting of truncated cones, bumps and ridges.

14. The assembly of claim 11, wherein said pad is flexible.

15. The assembly of claim 11, wherein said polymer material is chosen from the group of polymer materials consisting of polyurethane elastomers, rubbers, fiberglass reinforced polymers, and polymer composites.

* * * * *